US008051909B2

(12) United States Patent
Angelle et al.

(10) Patent No.: US 8,051,909 B2
(45) Date of Patent: Nov. 8, 2011

(54) METHOD AND APPARATUS FOR POSITIONING THE PROXIMAL END OF A TUBULAR STRING ABOVE A SPIDER

(75) Inventors: Jeremy R. Angelle, Lafayette, LA (US); Robert L. Tribodeaux, Jr., Lafayette, LA (US); Donald E. Mosing, Lafayette, LA (US); Vernon J. Bouligny, Jr., New Iberia, LA (US); Hans W. Schmidt, Lafayette, LA (US); Richard Wiggins, Runaway Bay, TX (US)

(73) Assignee: Frank's Casing Crew & Rental Tools, Inc., Lafayette, LA (US)

( * ) Notice: Subject to any disclaimer, the term of this patent is extended or adjusted under 35 U.S.C. 154(b) by 374 days.

(21) Appl. No.: 11/740,481

(22) Filed: Apr. 26, 2007

(65) Prior Publication Data

US 2008/0149326 A1 Jun. 26, 2008

Related U.S. Application Data

(63) Continuation-in-part of application No. 10/893,160, filed on Jul. 16, 2004, now Pat. No. 7,322,406.

(51) Int. Cl.
*E21B 44/02* (2006.01)
*E21B 47/00* (2006.01)
*E21B 19/16* (2006.01)

(52) U.S. Cl. .... 166/250.01; 166/53; 166/66; 166/77.51; 166/77.52; 166/379; 166/380

(58) Field of Classification Search ..... 166/53, 166/66, 379, 380, 250.01, 255.1, 77.51–77.53, 166/85.5

See application file for complete search history.

(56) References Cited

U.S. PATENT DOCUMENTS

| | | | | |
|---|---|---|---|---|
| 2,634,405 | A | | 4/1953 | Stone et al. |
| 3,881,375 | A | | 5/1975 | Kelly |
| 4,524,952 | A | | 6/1985 | Rome et al. |
| 4,604,724 | A | | 8/1986 | Shaginian et al. |
| 4,616,321 | A | * | 10/1986 | Chan ..... 702/9 |
| 4,676,312 | A | | 6/1987 | Mosing et al. |
| 4,748,563 | A | | 5/1988 | Anthoine |
| 4,829,489 | A | | 5/1989 | Rector |
| 5,791,410 | A | | 8/1998 | Castille et al. |
| 5,826,654 | A | | 10/1998 | Adnan et al. |

(Continued)

OTHER PUBLICATIONS

PCT/US2008/061237, "PCT International Search Report and Written Opinion", dated Feb. 3, 2010, 14 pages.

(Continued)

*Primary Examiner* — Hoang Dang
(74) *Attorney, Agent, or Firm* — Henry L. "Bud " Ehrlich; Winstead PC

(57) ABSTRACT

Method and apparatus for handling a supported tubular string with a string elevator and a spider on a rig to prevent damaging contact between the string elevator and spider while facilitating further connections of add-on tubular segments. The string elevator and supported tubular string descend toward the spider until reaching a predetermined position. The process of setting the spider into engagement of the tubular string is automatically initiated in response to detecting the predetermined position of the string elevator. With the spider set, the string elevator can be unloaded. Optionally, the method may also automatically terminate the string elevator descent in response to detecting that the spider has been set. A preferred apparatus for detecting the position of the elevator includes a tilt switch secured to a fixed position along the length of the Kelly hose.

16 Claims, 6 Drawing Sheets

U.S. PATENT DOCUMENTS

| | | | | |
|---|---|---|---|---|
| 5,909,768 | A | 6/1999 | Castille et al. | |
| 6,056,060 | A * | 5/2000 | Abrahamsen et al. | 166/380 |
| 6,073,699 | A | 6/2000 | Hollingsworth, Jr. | |
| 6,478,087 | B2 | 11/2002 | Allen | |
| 6,497,159 | B1 | 12/2002 | Lavoie | |
| 6,558,241 | B2 | 5/2003 | Hergott et al. | |
| 6,626,238 | B2 | 9/2003 | Hooper | |
| 6,742,596 | B2 * | 6/2004 | Haugen | 166/380 |
| 6,938,697 | B2 | 9/2005 | Haugen | |
| 7,086,461 | B2 * | 8/2006 | Schulze-Beckinghausen et al. | 166/77.53 |
| 7,140,443 | B2 | 11/2006 | Beierbach et al. | |
| 7,182,133 | B2 | 2/2007 | Webre et al. | |
| 7,222,677 | B2 * | 5/2007 | Webre et al. | 166/379 |
| 7,322,406 | B2 | 1/2008 | Wiggins et al. | |
| 2003/0106684 | A1 * | 6/2003 | Hooper | 166/64 |
| 2004/0159425 | A1 * | 8/2004 | Webre et al. | 166/66 |
| 2005/0120812 | A1 | 6/2005 | Edwin et al. | |
| 2005/0161225 | A1 * | 7/2005 | Cole et al. | 166/379 |
| 2006/0011350 | A1 | 1/2006 | Wiggins et al. | |
| 2007/0017682 | A1 | 1/2007 | Abrahamsen et al. | |

OTHER PUBLICATIONS

"SJH Horizontal Pickup Elevator" National Oilwell Varco, 2008, 1072 Rev. 03 brochure.

PCT "PCT International Preliminary Report on Patentability", PCT/US2008/061237, Feb. 18, 2010. 7 pages.

EPO, "Communication pursuant to Article 94(3) EPC", Application No. 08 746 624.9-1266, Ref. P114032EPPC/ASG, dated Jun. 1, 2010, 3 pages.

* cited by examiner

METHOD AND APPARATUS FOR POSITIONING THE PROXIMAL END OF A TUBULAR STRING ABOVE A SPIDER

This application is a continuation-in-part of U.S. patent application Ser. No. 10/893,160 filed on Jul. 16, 2004 now U.S. Pat. No. 7,332,406.

BACKGROUND

1. Field of the Invention

The present invention relates to methods and apparatus for handling a tubular string. More particularly, the invention relates to a method and apparatus for controlling a string elevator and a spider that handle and support the tubular string.

2. Background of the Related Art

When installing tubular strings, such as casing, the tubular string is alternately supported by a string elevator and spider. The string elevator is controlled by a driller and raised or lowered by a drawworks. The string elevator may include a set of slips that selectively grip or release the tubular string. The spider is controlled by a spider operator and also includes a set of slips that releasably grip or the tubular string, but the spider is not capable of being raised or lowered under the load of supporting the tubular string. Therefore, the stepwise advancement of a tubular string into a borehole requires coordinated use of the string elevator and the spider. Specifically, the spider supports the tubular string while an add-on tubular segment is coupled to the tubular string, and the string elevator supports the tubular string as the drawworks lowers the tubular string further into the borehole. This general process is repeated until the desired length of tubular string has been made up and run into the hole.

However, this process is greatly complicated by the immense load of the tubular string, the extent of damage that can be caused to the rig and the borehole by mishandling the string, and the tremendous investment of equipment and labor involved in operating the rig. The handling of the tubular string must be reliable, efficient, and safe at all times.

One specific challenge in the process of running the tubular string into the borehole is the need to get the internally threaded "box-end" at the proximal end of the tubular string as close as possible to the spider before transferring the load of the tubular string from the elevator to the spider. When the string elevator releases the string and an add-on tubular segment is being coupled, the threaded box should be easily accessible to the crew on the rig floor for making up the threaded connection without the need to scaffold up above the rig floor. Even with a flush mounted spider, the threaded box can be unsuitably high unless the string elevator is controllably lowered to an elevation that invades the operating zone of the spider.

Specifically, the spider typically includes a timing ring that is coupled to the slips within the spider and extends upward as much as two feet above the spider body when the slips are retracted to disengage the tubular string. When the slips of the spider are set to engage and grip the tubular string, however, the timing ring is substantially retracted into or immediately adjacent to the spider body. This "operating zone" defined by the range of vertical movement of the timing ring above the spider presents an opportunity to further descend the string elevator, and thus the threaded box, if the final portion of the descent of the elevator is properly coordinated with the setting of the spider slips. In fact, a driller and spider operator work hard to coordinate control of the elevator and spider so that the elevator can at least partially descend into the operating zone as the spider is actuated.

For example, when the driller lowers a tubular string into the borehole with the string elevator, instead of stopping right above the timing ring on the spider, the driller may continue to lower the elevator. At the same time, the spider operator may actuate the slips on the spider just before the arrival of the descending string elevator to vertically lower the timing ring. The driller may continue the descent of the string elevator such that it follows the timing ring downwardly through at least an upper portion of the operating zone until the spider slips are set on the casing string. As a result, the height of the internally threaded box-end on the proximal end of the tubular string is lowered by one or two feet more than if the string elevator simply stops short of the operating zone of the timing ring. This critical distance makes subsequent operations easier and safer by positioning the connection to be made up near the rig floor.

It is critical during this type of procedure that there be good communication between the driller (controlling the string elevator) and the spider operator. If communication fails, the string elevator may collide into the timing ring on the spider and result in damage to one or both pieces of equipment and lost rig time. Accordingly, the process is subject to operator error.

What is needed is a device and method for enabling the strategic and coordinated handling and positioning of the tubular string using the string elevator and the spider to facilitate the make up of the threaded connection between the proximal end of the tubular string and an add-on tubular segment. What is needed is a device and method for reliably and optimally positioning of the proximal end of the tubular string when the spider slips are set. It is desirable for the device and method automatically setting the spider slips when the string elevator has been lowered to a predetermined position in close proximity to the spider. It is also desirable to have a detector for reliably determining when a descending string elevator is close to contacting the spider.

SUMMARY OF THE INVENTION

The present invention provides a method of handling a tubular string using a string elevator and a spider on a rig. One embodiment of the method comprises the steps of descending the string elevator and supported tubular string, both relative to the spider, detecting that the string elevator has reached a predetermined proximity to the spider as the string elevator and supported tubular are lowered, and automatically initiating the process of slowing the descent of the string elevator and then setting the spider slips into engagement with the tubular string in response to detecting the predetermined proximity of the string elevator. A similar embodiment comprises these same steps with an additional step of descending the string elevator further, after the spider slips are set into engagement with the tubular string, to unload the string elevator.

An alternate embodiment of the method of the present invention comprises descending the string elevator and supported tubular string relative to the spider, detecting that the string elevator has reached a predetermined proximity to the spider as the string elevator and supported tubular string are lowered, and alerting the driller that the predetermined proximity of the string elevator to the spider has been achieved. The alert to the driller may be automatic. Another alternate embodiment of the method of the present invention comprises descending the string elevator and supported tubular string relative to the spider, detecting that the string elevator has reached a predetermined proximity to the spider as the string elevator and supported tubular string are lowered, alerting the driller that the predetermined proximity of the string elevator to the spider has been achieved, automatically slowing the descent of the string elevator, and automatically transferring control of the rate of descent of the string elevator to the driller. The predetermined position of the string elevator may be detected as a quantitative measurement that reaches a predetermined set point, or as a discrete indicator.

Each embodiment of the method of the present invention may further include the step of automatically unloading the string elevator after the spider slips have been set. For example, the string elevator may be unloaded by a step selected from the group consisting of: descending the string elevator a predetermined distance after the slips of the spider have been set; descending the elevator until detecting either a predetermined string elevator load set point or a predetermined spider load set point, or both; descending the string elevator until the elevator slips are determined to be opened; descending the string elevator until detecting a second proximity of the string elevator to the spider; and combinations thereof. Preferably, the method will further comprise the steps of automatically slowing and then terminating descent of the string elevator in response to detecting that the spider has begun to set or has set, and automatically releasing the string elevator from the tubular string. Interlocking the string elevator controls and the spider controls may be desirable so that neither the string elevator nor the spider can release the tubular string unless the other of the string elevator or spider grips and supports the tubular string within the borehole.

In a preferred method, the step of detecting the position of the elevator includes the step of monitoring the position of a slack line having a first end in a fixed elevated position and second end coupled to any component traveling vertically with the string elevator. For example, the second end of the slack line may be secured to the string elevator, a top drive, bails, or the drawworks. The slack line may be any tube, cable, hose, cord, rope, chain, combinations thereof, or bundles thereof, but is most preferably selected from a Kelly hose, a hydraulic hose bundle, and a pneumatic hose bundle. Because a slack line hangs under gravity in a known and repeatable manner, the step of monitoring the position of a slack hose may include the step of monitoring the tilt angle at a selected point along the length of the slack line. Optionally, the tilt angle is monitored by a tilt switch secured to the hose at the selected point along the length of the slack line. Typically, the selected point may be empirically determined by lowering the elevator into the desired position relative to the spider and securing the tilt switch to the hose at a point where the tilt switch will repeatably produce a signal at a selectable position achieved during the downward travel of the string elevator toward the spider.

The present invention also provides an apparatus for handling a supported tubular string. The apparatus comprises a string elevator with a set of slips and an actuator for releasably gripping the tubular string, a drawworks supported by a rig for controllably raising and lowering the string elevator, and a spider with a set of slips and an actuator for releasably gripping the tubular string. The apparatus further comprises one or more string elevator position detectors for detecting the position of the string elevator as the string elevator and supported tubular string descend, a spider engagement detector for detecting that the spider has been set, and a controller in communication with the string elevator position detector, the spider engagement detector, the elevator slips actuator, the drawworks, and the spider slips actuator. The controller automatically actuates the spider actuator forcing the spider slips into engagement of the tubular string in response to a signal from the elevator position detector indicating the position of the string elevator. The controller also instructs the drawworks to slow the descent of the string elevator in response to a signal from the spider engagement detector indicating that the spider has begun to set or has been set. Furthermore, the controller may automatically actuate the string elevator actuator to retract the string elevator slips from engagement with the tubular string in response to detecting that the load of the tubular string has been successfully transferred to the spider.

In one embodiment, the elevator position detector is a tilt switch attached to a fixed point along the length of a flexible line hanging between the rig and any component that descends vertically with the string elevator, wherein movement of the string elevator to a predetermined height causes a change in the angle of the flexible line at the point of attachment that initiates a signal from the tilt switch indicating the position of the string elevator.

The present invention further provides an apparatus for monitoring the position of a first member relative to a second member. The apparatus comprises a flexible line hanging freely between a first end secured to a first member and a second end secured to a second member, wherein at least one of the first and second members travels along a known path that changes the distance between the first and second ends. A tilt switch is attached to a fixed point along the length of the flexible line, wherein movement of the traveling member to a predetermined point along the known path causes a change in the cable angle at the point of attachment that initiates a signal from the tilt switch.

The flexible line may be selected from a tube, cable, hose, cord, rope, chain, combinations thereof, or bundles thereof. Preferably, the flexible line hangs in a dynamically-repeatable and catenary-like manner.

In an optional embodiment, the apparatus further comprises a second tilt switch attached to a second point along the length of the flexible line, wherein movement of the traveling member to a second predetermined point along the known path causes a change in the angle of the flexible line at the second point of attachment that initiates a signal from the second tilt switch to the controller indicating the position of the string elevator.

In another optional embodiment, a tilt switch comprises two or more misaligned chambers for initiating two or more signals, each related to a distinct position of the switch, each for initiating a signal to the controller. The misaligned chambers may be joined or separate.

The foregoing and other objects, features and advantages of the invention will be apparent from the following more particular description of a preferred embodiment of the invention, as illustrated in the accompanying drawing wherein like reference numbers represent like parts of the invention.

DETAILED DESCRIPTION

Figure 1:
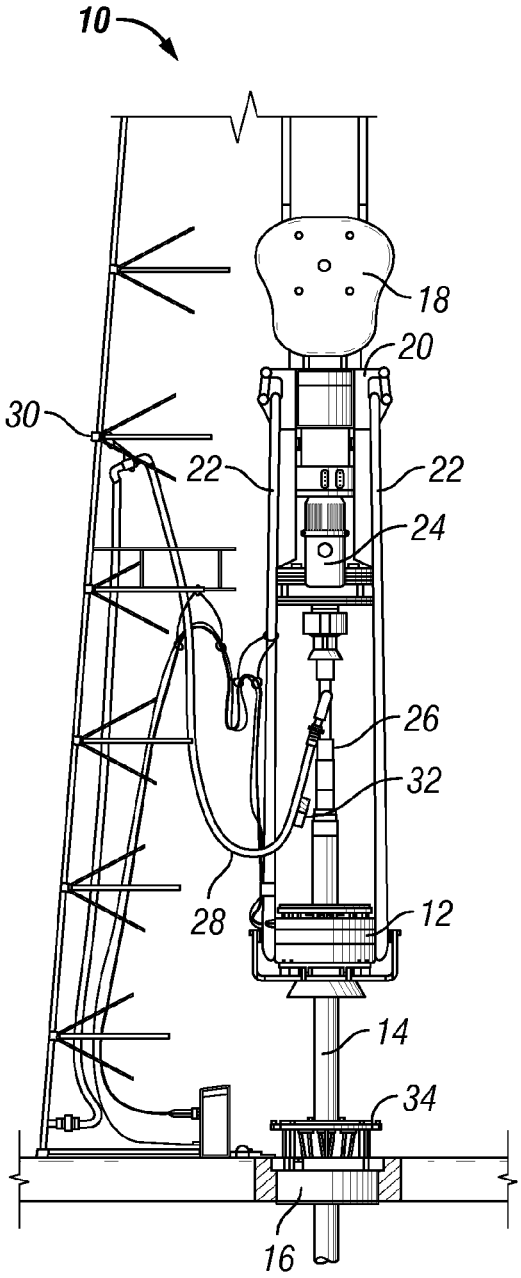
FIG. 1 is a partial side view of a rig with a string elevator supporting a tubular string.

The present invention provides a method of handling a supported tubular string with a string elevator and a spider on a rig. The method comprises descending the string elevator and supported tubular string relative to the spider, and detecting that the string elevator has reached a predetermined position above the spider as the string elevator and supported tubular string are lowered. One embodiment of the method of the present invention comprises the step of automatically alerting the driller that the string elevator has reached a predetermined proximity to the spider so that steps can be taken by the driller to coordinate movement between the string elevator and the spider. In an alternate embodiment of the method of the present invention, the method comprises the step of automatically initiating the process of slowing the rate of descent of the string elevator toward the spider. In another alternate embodiment of the present invention, the method comprises the step of initiating the setting of the spider into engagement of the tubular string in response to detecting a predetermined proximity of the string elevator. This method may further comprise monitoring the status of the spider, determining when the spider slips have begun to set and automatically terminating the descent of the string elevator either after the string elevator has been lowered a predetermined distance after the spider slips began to set or upon detecting of a second predetermined position of the string elevator. Alternately, the method comprises descending the string elevator and supported tubular string relative the spider, detecting that the string elevator has reached a predetermined proximity to the spider as the string elevator and supported tubular string are lowered, and automatically initiating the process of slowing the descent of the string elevator and transferring control of the descent of the string elevator to the driller. Another embodiment of the method of the present invention includes the step of alerting the spider operator that the string elevator has invaded the operating zone of the spider, which indicates that the proximal end of the tubular string is positioned at or near its optimal elevation.

The predetermined proximity of the string elevator may be identified as an absolute position or elevation relative to the rig, or the position of the string elevator may be identified as a relative position or proximity relative to the spider. In most instances, these two configurations can yield the same results. For example, since the spider is typically stationary, such as a flush-mounted spider, the absolute position of the spider relative to the rig does not change during operations. Therefore, movement of the string elevator is the same whether that movement is measured or detected relative to the spider or the rig. This makes it is possible and entirely practical to simply detect the position of the string elevator, or other component in the same translating assembly, with respect to another point on the rig to identify one or more points at which the string elevator approaches the known position of the spider. An advantage of this approach is that the detector can be located away from the spider, the string elevator, and the zone there between, where a detector may interfere with operations or become damaged.

However, the position of the string elevator may be detected as a more direct measure of the proximity between the string elevator and the spider. For example, a sensor, signal generator or switch may be mounted on the string elevator or on the spider, or on both, for generating a signal when the distance therebetween reaches a predetermined set-point. This type of installation might be useful where the spider includes a timing ring that moves vertically between the spider body and the string elevator. When trying to optimize positioning of the anticipated threaded connection between an add-on tubular segment and the tubular string suspended by the spider, while preventing the string elevator from making contact with any portion of the spider, such as the timing ring, it can be useful to recognize that the distance between the spider and string elevator is a function of the instantaneous positions of both the timing ring and the string elevator. For example, mounting a sensor on the timing ring and directing it at the string elevator, or mounting a sensor on the string elevator directed at the timing ring, enables direct information about the relative positions of these two components as they both move. Suitable sensors include, without limitations, a photo-electric sensor, an ultrasonic sensor, including but not limited to ultrasonic pulse echo device, a mechanical actuator, a laser distance measurement device, and a radar sensor.

The predetermined proximity of the string elevator to the spider may be detected as a quantitative measurement that reaches a predetermined set-point or as a discrete indicator. For example, a quantitative measurement may be made by an ultrasonic sensor continuously measuring the position of the string elevator, or the distance between the string elevator and the spider, for comparison of the measurement against a set-point to determine when predetermined position has been reached. Alternatively, a discrete indicator may be a proximity switch that generates a Boolean signal the instant that the predetermined position is reached. Such a Boolean signal may be either a "high" or "low" signal, but such signal is preferably selected to provide a fail-safe mode. For example, failure of the discrete indicator will preferably result in a "low" signal that causes the drawworks to substantially slow in its decent and the spider to prematurely set.

In one embodiment, a discrete indicator is implemented in the form of a "tilt switch" or "inclination sensor." The tilt switch is adapted for being secured to a hose, such as a Kelly hose. The hose contains slack for accommodating the vertical reciprocation of a string elevator or a top drive relative to the rig. The tilt switch may comprise a chamber in which a body, such as a ball, is movably captured. The chamber may be sufficiently large to allow the body to move from one end of the chamber toward or to another end of the chamber as acted upon by gravity. The tilt switch may include one or more proximity sensors positioned near one or more ends or sides of the chamber for detecting the position of the movable body within the chamber.

The tilt switch is preferably attached to a segment of the hose in such a manner that the chamber is secured in a generally parallel relationship with the segment. Since the chamber is typically rigid and the hose is substantially more flexible, the relationship of the chamber to the hose might be described as a tangent to the curve of the hose segment. However, it is not essential that the chamber be either parallel or tangent, so long as the switch generates a signal when the string elevator reaches the predetermined position.

The positioning of a given tilt switch at point along the length of the hose is very important. The fixed point may be determined empirically by lowering the elevator into the desired proximity with the spider and securing the tilt switch to the hose at a point where the tilt switch will produce a signal at the desired movement during the downward travel of the elevator. If the tilt switch is attached with the chamber running tangentially to the hose, then the tilt switch will be attached almost exactly at the low point in the catenary-like path formed by the hanging hose when the string elevator is located at the predetermined position. This is the preferred position for attachment of the tilt switch, because the low point in a catenary-like path bends more at this point than any other point along the length of the hose. Accordingly, the tilt switch can achieve more accurate detection when positioned in this manner. Still, it should be recognized that the tilt switch could also be positioned at another point along the hose and attached at an "angle" relative to the hose, such that the tilt switch would still produce a signal when the string elevator reached the predetermined position during the downward travel of the elevator.

When the string elevator descends to the predetermined position, the inclination of the hose at the attachment point of the tilt switch changes and the inclination of the chamber in the tilt switch also changes. As the incline of the chamber moves past horizontal, the body moves within the chamber as acted upon by gravity. When the body moves away from a proximity sensor, a signal is generated indicating that the string elevator has reached the predetermined position. Preferably, this signal communicates with the controls of the spider which cause the spider slips to be set. This automatic control over the spider eliminates the driller having to communicate with spider operator regarding when to set the spider. The driller can just continue to controllably lower the elevator knowing that the slips on the spider will automatically begin to set when the elevator reaches the predetermined position.

The string elevator may continue to descend while the slips on the spider are being set. Since the spider slips are not set instantaneously, the string elevator may descend a significant distance of perhaps another 1 to 2 feet while the spider slips are being set into engagement with the tubular string. Where the spider includes an upwardly extending timing ring, the string elevator and timing ring may descend simultaneously. It is important that the string elevator does not hit or contact the timing ring and, preferably, the string elevator and timing ring may descend at about the same rate so that the string elevator invades the operating zone of the timing ring.

Once the spider slips are set, the string elevator may be unloaded. Unloading the string elevator means that the load of the tubular string is transferred to the spider. Since the spider slips are set at this point, the spider is ready to receive the load as the string elevator descends even a small distance further. The distance that the string elevator must descend to unload is typically small enough that the string elevator will still not hit or contact the spider while being lowered to its final descent position. Still, it is preferable that the string elevator stop descending as soon as the load of the tubing string is transferred to the spider. Optionally, the string elevator may begin stopping in response to detecting that the spider is set, such as by transmitting a signal to the drawworks safety system to initially slow, and then to stop the descent of the traveling block. The drawworks might also wait for a brief time delay, advance the string elevator a short unloading distance, or take other measures between receiving a signal that the spider is set and automatically stopping descent of the string elevator.

It is not necessary to have an exact indication of when the string elevator is unloaded and the spider is loaded. Rather, the slips on the string elevator may be urged to their retracted (unset) position, but retained in their engaged position by the load on the slips that resists the retracting force on the slips, and the elevator may continue descending until the slips on the string elevator disengage as a result of being substantially unloaded. In other words, the slips on the string elevator will disengage the tubular string and retract when the load is substantially off of the string elevator and transferred to the spider. However, on some string elevators that are powered by hydraulics, the string elevator may not have to be lowered much, if any at all, in order to unload the string elevator slips.

After the string elevator has released the tubular string, the string elevator is raised and removed from the tubular string, and may be manipulated to lift an add-on tubular segment into place for making up a connection to the tubular string. Typically, this means axially aligning and lowering the pin end of the add-on tubular segment into the upwardly disposed box end of the tubular string. As mentioned before, it is preferable that the connection of the add-on tubular segment occur at a strategically low elevation above the spider so that an operator can assist with the connection without strain or hazard. The automation made possible by the present invention allows a connection to safely and repeatably occur at a desirable elevation above the spider or the rig floor.

Therefore, the present invention enables the strategic handling of a tubular string to prevent damage to the spider or the string elevator while facilitating efficient and safe connection of add-on tubular segments into the tubular string. In one embodiment, the invention provides an automated device and method for preventing a string elevator from contacting and damaging a spider, particularly a spider with a timing ring or a top cover.

FIG. 1 is a partial side view of a rig 10 with a string elevator 12 supporting a tubular string 14 that extends through a spider 16. The string elevator 12 descends to lower the tubular string 14 into a borehole at a rate controlled by a drawworks, which includes the traveling block 18. The traveling block 18 is coupled to a collar 20 that supports a pair of opposing bails 22 having a distal end securing the string elevator 12. Accordingly, the components between and including the traveling block 18 and the string elevator 12 ascend and descend as a translating assembly. As shown, the translating assembly also includes a top drive 24 including a downwardly disposed fill-up and circulation tool 26 that allows fluid introduction and/or circulation through the tubular string 14 while the tubular string is being lowered into the borehole. Fluid is supplied to the bore of the tubular string 14 through the Kelly hose 28 that extends from the rig structure 30 to the fill-up and circulation tool 26. A tilt switch 32 is attached to the Kelly hose 28 at a fixed point along the length of the Kelly hose 28 so that the tilt switch 32 will generate a signal when the string elevator 12 descends to a predetermined proximity to the spider 16. Generally, the predetermined proximity of the string elevator 12 to the spider is that position where the slips of the spider 16 should begin to set or, alternately, that position where the string elevator 12 should begin to slow its rate of descent in preparation for approaching the spider. The spider 16 includes a timing ring 34 that extends upward above the spider body, which is shown in FIGS. 1-5 as a flush-mounted spider.

Figure 1A:
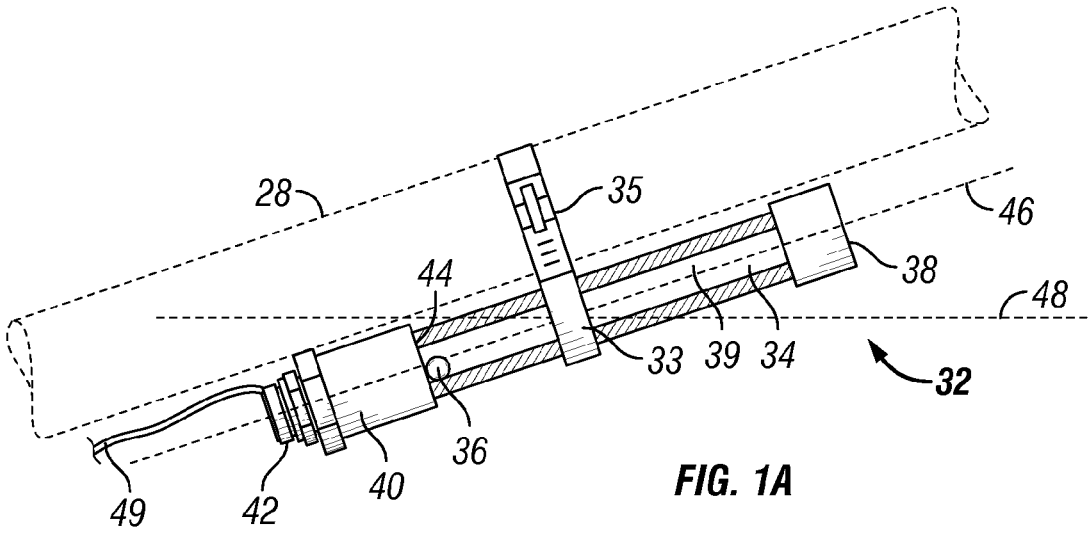
FIG. 1A is a cross-sectional side view of a tilt switch, as shown in FIG. 1, that is capable of generating a signal when the switch reaches a given angle.

FIG. 1A is a cross-sectional side view of a tilt switch 32, as shown in FIG. 1, that is capable of generating a signal when the switch rotates to a given angle. The tilt switch 32 may be attached to a segment along the Kelly hose 28, a hydraulic hose, a pneumatic hose, or a bundle of hoses in the derrick. The type of attachment may include any known attachment method. For example, the tilt switch 32 might be attached by a metal band 33 around the tilt switch 32 that is coupled to a hose clamp 35 secured around the Kelly hose 28. While the clamp or other attachment system should not damage the hose, it is important that the tilt switch be secured to the hose without slipping along the length of the hose. As shown, the tilt switch 32 is secured to the Kelly hose 28 at a fixed point of attachment defined by the hose clamp 35.

The chamber 39 inside the tilt switch 32 may be defined by an axial centerline 46 that may be generally described a tangent to the curvature in the Kelly hose 28 at the point of attachment. For reference, a horizontal line 48 is shown to indicate the inclination beyond which the tilt switch 32 will be actuated to generate a signal.

The exemplary tilt switch 32 has a main chamber 34 that can be made from a piece of PVC pipe. A detectable body, such as a ball 36, which may in one embodiment comprise a metal ball bearing, is captured within the chamber 39 before the PVC pipe is closed off by gluing PVC caps 38, 40 over each end of the chamber. A first end cap 40 has been modified to threadably receive a proximity sensor 42 capable of detecting whether or not the ball 36 is positioned against the proximity sensor wall 44. The chamber 39 may be filled with air, an inert gas, or a low viscosity fluid, such as oil, to protect the ball and sensor from environmental damage while still allowing the ball to reliably move from one end of the chamber 39 toward or to the other as acted upon by gravity.

The tilt switch 32 is preferably attached to the Kelly hose 28 in a particular orientation such that the ball 36 is in contact with the wall 44 adjacent the proximity switch 42 as the string elevator descends toward the predetermined position. As the elevator descends, the tilt switch will rotate (and translate) due to the movement of one end of the hanging hose.

Figure 2:
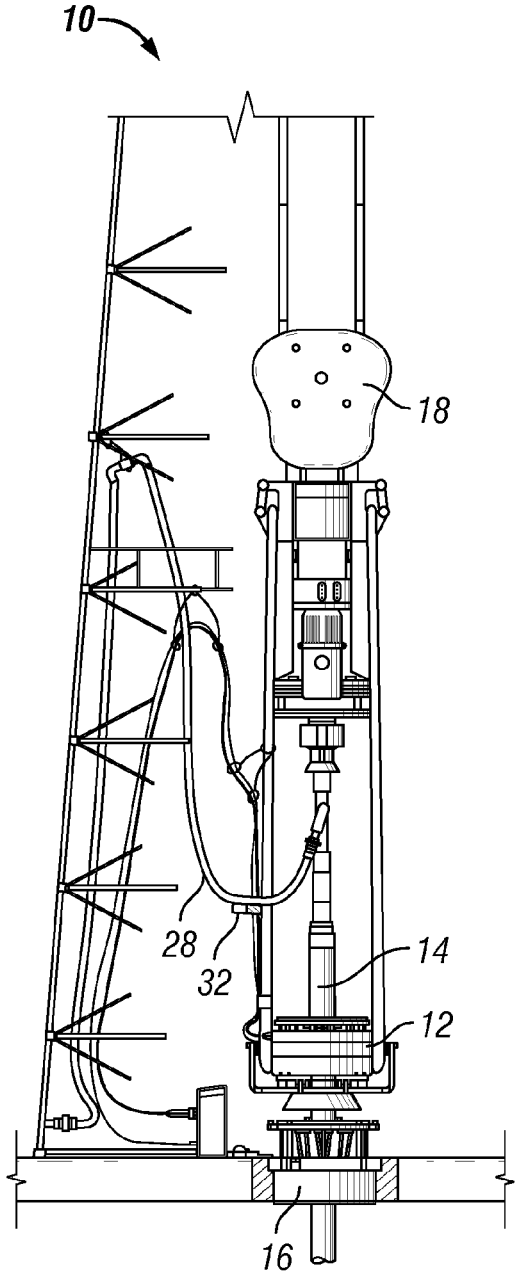
FIG. 2 is a partial side view of the rig of FIG. 1 with the string elevator and tubular string descending toward a spider.

FIG. 2 is the partial side view of the rig 10 of FIG. 1 with the string elevator 12 and tubular string 14 descending toward the spider 16. When the string elevator 12 reaches the predetermined position as shown, the tilt switch 32 generates a signal that can be communicated to a controller (not shown in FIG. 2). However, the fixed point where the tilt switch 32 is attached will typically be determined empirically by lowering the elevator 12 into the desired threshold proximity with the spider 16 and securing the tilt switch 32 to the Kelly hose 28 at a point where the tilt switch 32 will produce a signal at the desired proximity achieved during the downward descent of the string elevator 12. In accordance with a preferred embodiment, the signal generated by the tilt switch 32 is used to initiate the setting of the slips of the spider 16 or to slow the rate of descent of the string elevator 12 or to alert the driller that the string elevator 12 has achieved the first predetermined proximity to the spider 16.

Figure 2A:
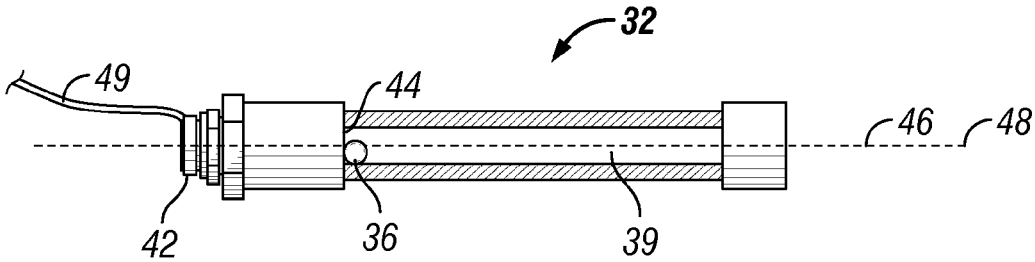
FIG. 2A is a cross-sectional side view of the tilt switch of FIG. 2 just before generating a signal.

FIG. 2A is a cross-sectional side view of the tilt switch 32 of FIG. 2 with the axial centerline 46 lying substantially on the horizontal 48 just before generating a signal. As shown, the tilt switch has not yet generated the signal, but gravitational forces are no longer biasing the ball 36 against the wall 44.

Figure 2B:
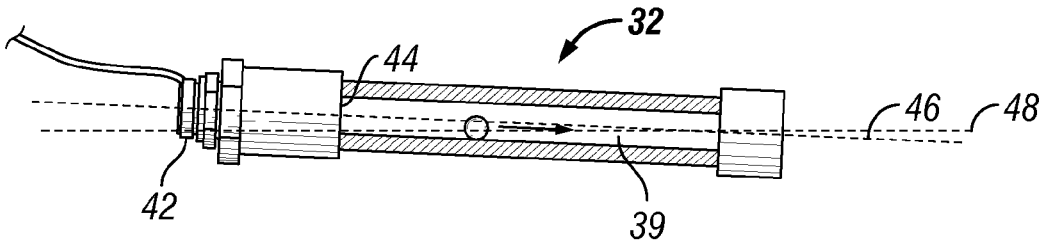
FIG. 2B is a cross-sectional side view of the tilt switch of FIG. 2 generating a signal that indicates the position of the string elevator.

FIG. 2B is a cross-sectional side view of the tilt switch 32 (at a moment immediately following that shown in FIG. 2A) with the axial centerline 46 having rotated clockwise past the horizontal 48, causing the ball bearing 36 to roll as acted upon by gravity and to lose contact with or roll from the wall 44 of the proximity switch 42. When the ball bearing moves away from the proximity switch, a signal is sent via an electrical wire 49 or, optionally, by wireless transmission. The signal may, in one embodiment of the present invention, be sent to an actuator in the spider control panel (not shown) to automatically initiate the process of setting the slips on the spider 16. As previously mentioned, the "signal" generated by the proximity switch 42 may be a "high" or "low" signal, where a low signal (with no voltage) may be used to indicate that the proximity switch 42 has lost contact with the ball bearing 36. In this manner, any damage to the electrical wire 49 or proximity switch 42, or even any loss of power on the rig, would cause a low signal that would slow and terminate descent of the string elevator and set the slips of the spider 16. Alternately, the controller may be programmed such that an event such as damage to the electrical wire or proximity switch, or even a loss of power on the rig would cause a low signal that would slow the descent of the string elevator and alert the driller to the condition so that remedial measure may be taken.

Alternately, the signal generated by the tilt switch 32 may be sent to an actuator in the drawworks control panel to automatically initiate the process of slowing the rate of descent of the string elevator 12 toward the spider 16, or the signal generated by the tilt switch 32 may be sent to an actuator in the driller's control panel to automatically alert the driller that the descending string elevator 12 has achieved a first proximity to the spider 16 that warrants action on his or her part to coordinate movements of the string elevator 12 and the spider 16.

Figure 3A:
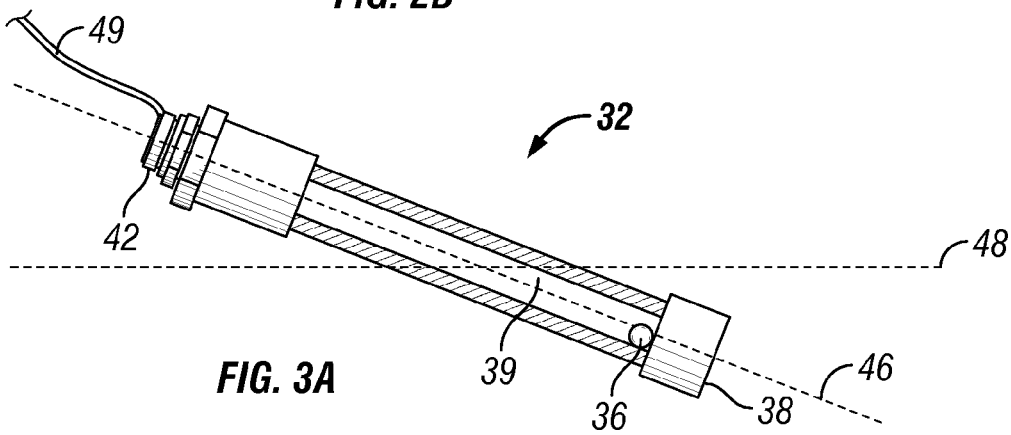
FIG. 3A is a cross-sectional side view of the tilt switch of FIG. 3 continuing to generate a signal.
Figure 3:
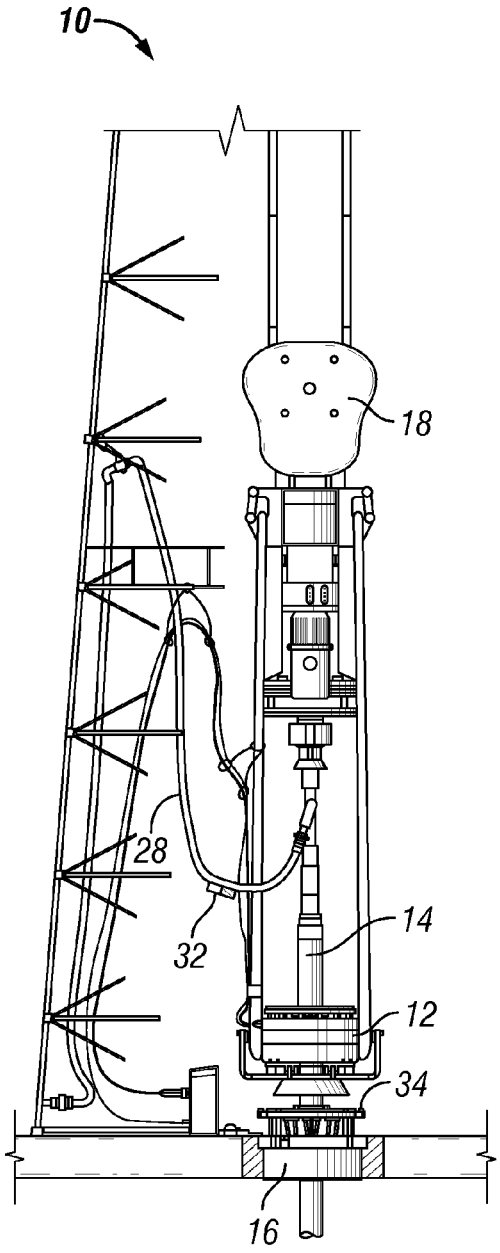
FIG. 3 is a partial side view of the rig of FIGS. 1-2 with the string elevator having descended to a position where an elevator position detector generates a signal.

FIG. 3 is the partial side view of the rig 10 of FIGS. 1-2 with the string elevator 12 and the timing ring 34 of the spider 16 having both descended to a position lower than that shown in FIG. 2. The timing ring 34 on the top portion of the spider 16 has partially descended as the descent of the string elevator approaches its lowermost position and the slips within the spider 16 have begin to set. Generally, a timing ring may be coupled to the spider slips in order to assure that each of the slips moves into position for generally simultaneous engagement with the tubular string. However, the actuation of the spider has moved the timing ring lower so that the string elevator has been able to descend correspondingly lower to favorably position the proximal end of the tubular string for subsequent connection of an add-on tubular segment. Optionally, the string elevator 12 may descend roughly at a rate that will maintain a given spacing between the timing ring 34 and string elevator 12.

FIG. 3A is a cross-sectional side view of the tilt switch 32 of FIG. 3 continuing to generate a signal as in FIG. 2B. While the tilt switch continued to rotate from the position shown in FIG. 2B, the ball traversed at least a portion of the length of the chamber 39, and the position of the ball remains against or nearer to the end cap 38 under the force of gravity. Only when the drawworks sufficiently raises the string elevator 12 will the ball bearing 36 roll back along a portion of the chamber to the wall 44 to reset the tilt switch for the next descent.

Figure 4:
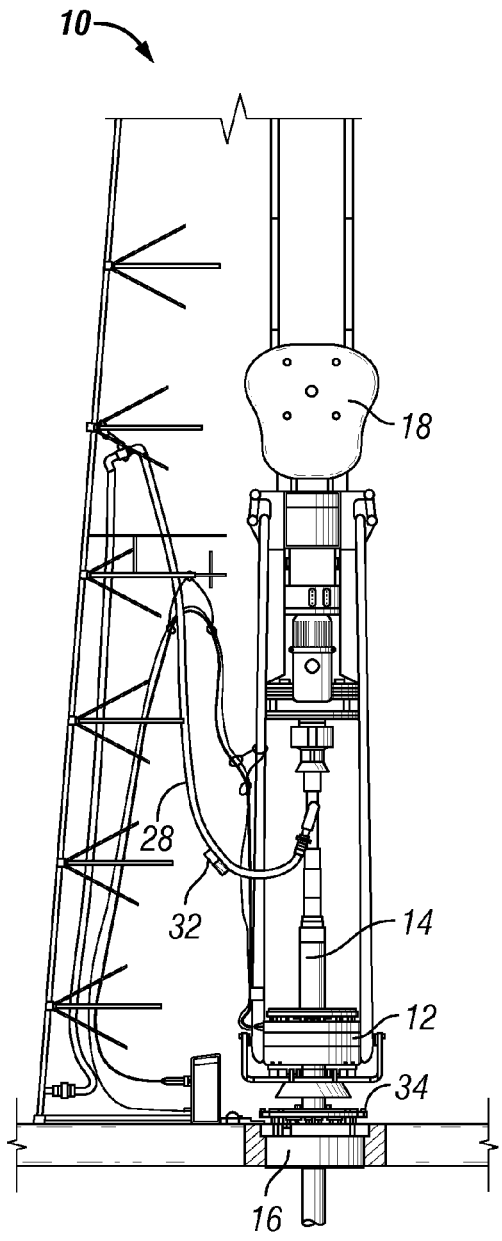
FIG. 4 is a partial side view of the rig of FIGS. 1-3 with the string elevator and a timing ring of the spider simultaneously descending.

FIG. 4 is the partial side view of the rig of FIGS. 1-3 with the string elevator 12 and the timing ring 34 of the spider 16 having both descended until the slips of the spider 16 have been fully set to grip the tubular string 14. Accordingly, the spider 16 is ready to support the load of the tubular string 14, although the string elevator 12 is still gripping and supporting the load of the tubular string 14. Optionally, a detector may identify that the spider slips are fully set to engage and support the tubular string 12, and the detector may then generate a signal to the drawworks control panel (not shown), for example, to further slow and then stop the descent of the string elevator 12. Alternately, the detector may at this point generate a signal to the driller's control panel (not shown) to alert the driller that only a slight further descent of the string elevator 12 is needed to unload the string elevator 12 and transfer the load to the spider 16.

Figure 5:
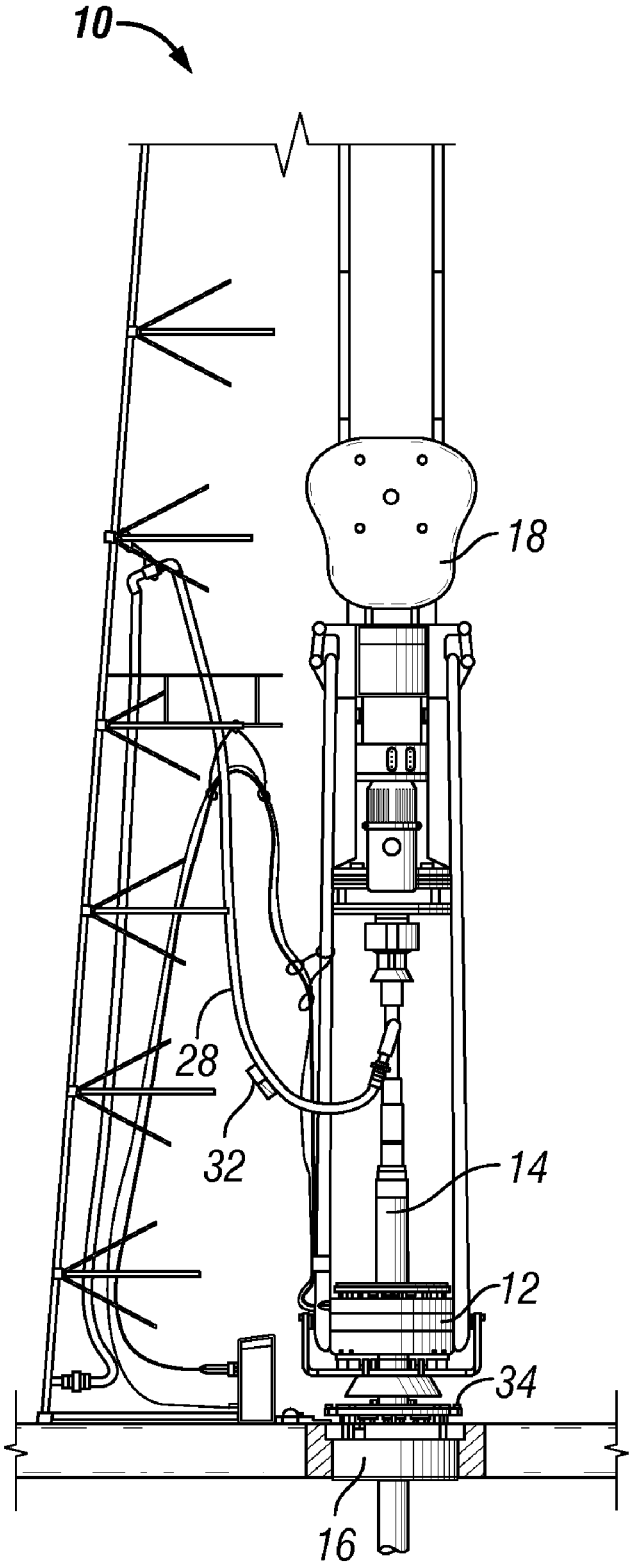
FIG. 5 is a partial side view of the rig of FIGS. 1-4 with the spider set to grip the tubular string and the string elevator fully descended to release the tubular string.

FIG. 5 is the partial side view of the rig 10 of FIGS. 1-4 with the spider 16 having been set to grip and loaded to support the tubular string 14, and the string elevator 12 fully descended to release the tubular string. Comparison of FIG. 5 to FIG. 4 shows that, once the spider slips are engaged with the tubular string, even a small further descent of the string elevator 12 is sufficient to unload the weight of the tubular string 14 from the string elevator 12 and load the spider 16. This unloading of the string elevator 12 allows the slips in the string elevator 12 to be unseated and moved out of engagement with the tubular string 14. Where the slips in the string elevator 12 are hydraulically actuated to retract, it is possible that the slips may be unloaded without requiring that the string elevator descend this last small distance. Still, it is generally preferred that unloading the string elevator 12 includes at least some further descent of the string elevator after the spider slips are set into engagement with the tubular string 14.

After unloading the string elevator 12, the string elevator may be raised by the drawworks and removed from the proximal end of the tubular string and, optionally, used to lift an add-on tubular segment into position at well center for connection to the favorably positioned proximal end of the tubular string. The connection of an add-on tubular segment into the tubular string will be easier and safer with the precise positioning of the threaded connection above the spider by use of the present invention.

Figure 6:
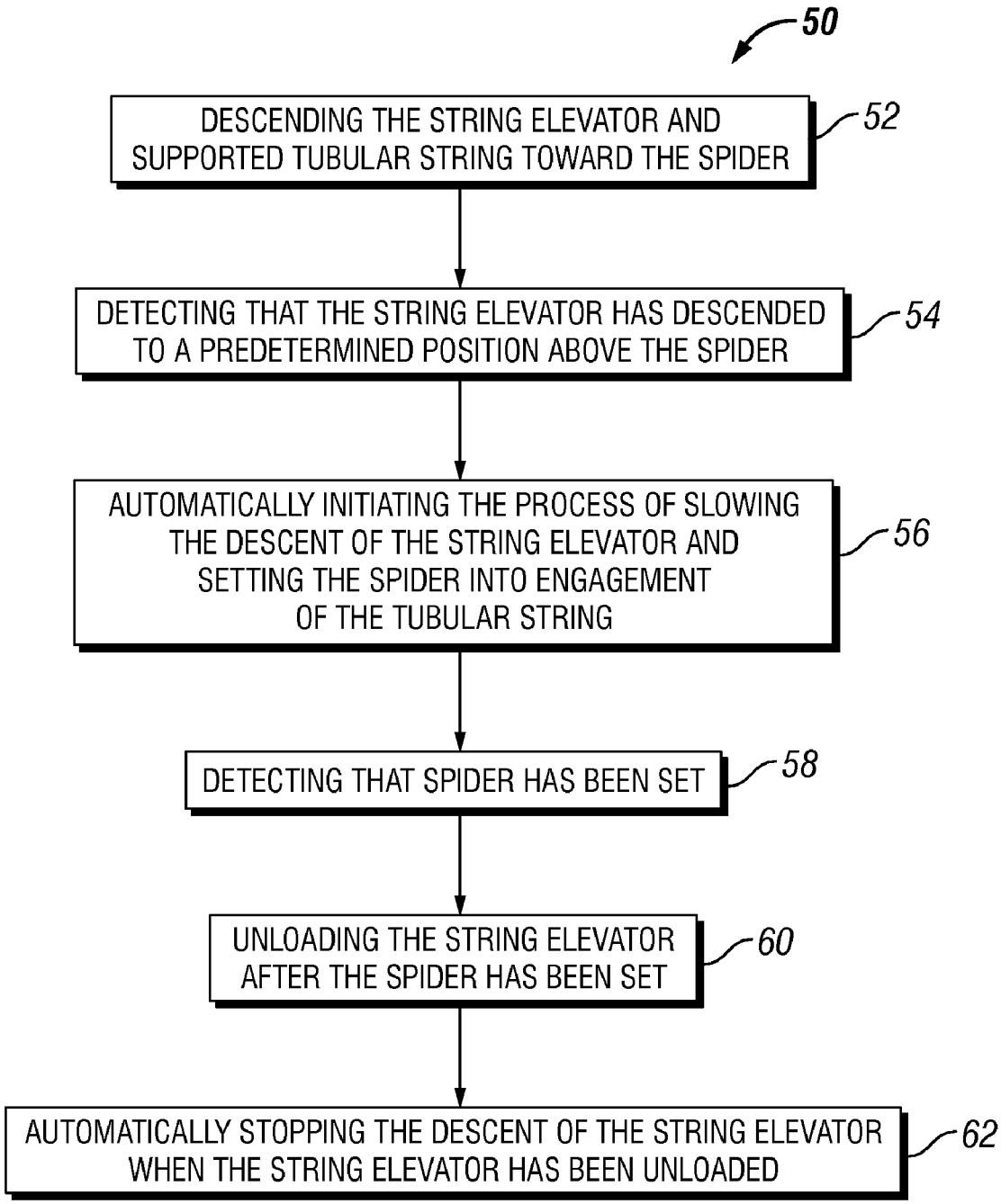
FIG. 6 is a flowchart of a preferred method of the invention.

FIG. 6 is a flowchart illustrating a preferred method 50 in accordance with the present invention. In step 52, the string elevator and supported tubular string are descended toward the spider. In step 54, it is detected that the string elevator has descended to a predetermined position above the spider. The process of slowing the descent of the string elevator and setting the spider into engagement with the tubular string is automatically initiated in step 56. After detecting that the spider has been set in step 58, the string elevator can be unloaded in step 60. Unloading of the string elevator is generally accomplished by slight further descent of the string elevator after detecting that the spider has been set into engagement with the tubular string. In step 62, the slight further descent of the string elevator is automatically stopped once the string elevator has been unloaded.

Figure 7:
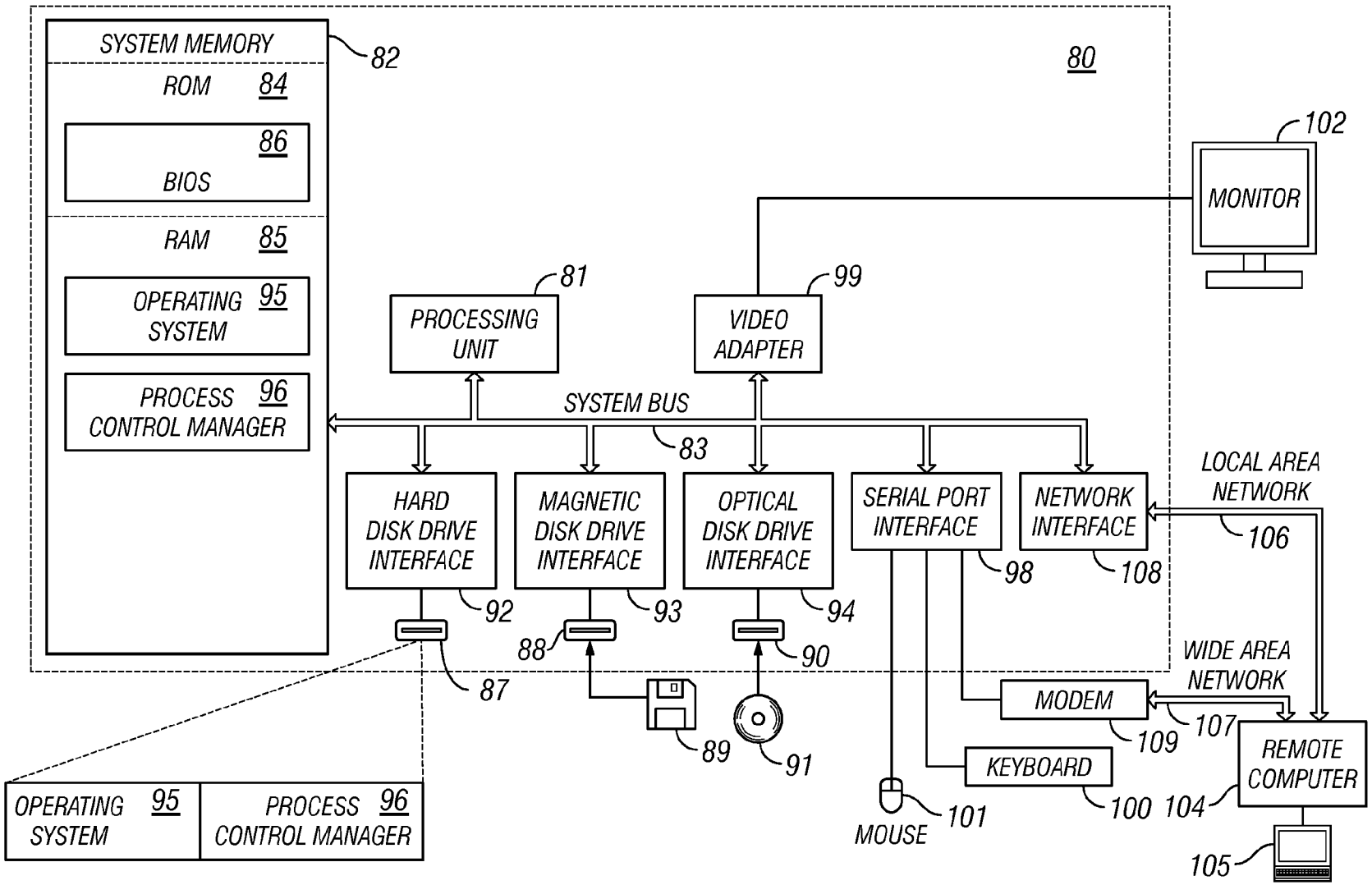
FIG. 7 is a schematic diagram of a computer system that is capable of controlling the methods of the present invention.

While the methods of the present invention may be implemented by directing individual signals to individual valves or through one or more local analog controllers, the methods may also be implemented partially or completely controlled by a digital computer that communicates between the driller's control panel, the drawworks control panel and the spider control panel, and other detectors, sensors, and the like. FIG. 7 is a schematic diagram of a computer system 80 that is capable of controlling the methods of the present invention. The system 80 may be a general-purpose computing device in the form of a conventional personal computer 80. Generally, a personal computer 80 includes a processing unit 81, a system memory 82, and a system bus 83 that couples various system components including the system memory 82 to processing unit 81. System bus 83 may be any of several types of bus structures including a memory bus or memory controller, a peripheral bus, and a local bus using any of a variety of bus architectures. The system memory includes a read-only memory (ROM) 84 and random-access memory (RAM) 85. A basic input/output system (BIOS) 86, containing the basic routines that help to transfer information between elements within personal computer 80, such as during start-up, is stored in ROM 84.

Computer 80 further includes a hard disk drive 87 for reading from and writing to a hard disk 87, a magnetic disk drive 88 for reading from or writing to a removable magnetic disk 89, and an optical disk drive 90 for reading from or writing to a removable optical disk 91 such as a CD-ROM or other optical media. Hard disk drive 87, magnetic disk drive 88, and optical disk drive 90 are connected to system bus 83 by a hard disk drive interface 92, a magnetic disk drive interface 93, and an optical disk drive interface 94, respectively. Although the exemplary environment described herein employs a hard disk 87, a removable magnetic disk 89, and a removable optical disk 91, it should be appreciated by those skilled in the art that other types of computer readable media which can store data that is accessible by a computer, such as magnetic cassettes, flash memory cards, digital video disks, Bernoulli cartridges, RAMs, ROMs, and the like, may also be used in the exemplary operating environment. The drives and their associated computer readable media provide nonvolatile storage of computer-executable instructions, data structures, program modules, and other data for computer 80. For example, the operating system 95 and application programs, such as a process control manager 96, may be stored in the RAM 85 and/or hard disk 87 of the computer 80.

A user may enter commands and information into personal computer 80 through input devices, such as a keyboard 100 and a pointing device, such as a mouse 101. Other input devices (not shown) may include a microphone, joystick, game pad, satellite dish, scanner, or the like. These and other input devices are often connected to processing unit 81 through a serial port interface 98 that is coupled to the system bus 83, but input devices may be connected by other interfaces, such as a parallel port, game port, a universal serial bus (USB), or the like. A display device 102 may also be connected to system bus 83 via an interface, such as a video adapter 99. In addition to the monitor, personal computers typically include other peripheral output devices (not shown), such as speakers and printers.

The computer 80 may operate in a networked environment using logical connections to one or more remote computers 104. Remote computer 104 may be another personal computer, a server, a client, a router, a network PC, a peer device, a mainframe, a personal digital assistant, an Internet-connected mobile telephone or other common network node. While a remote computer 104 typically includes many or all of the elements described above relative to the computer 80, only a display device 105 has been illustrated in the figure. The logical connections depicted in the figure include a local area network (LAN) 106 and a wide area network (WAN) 107. Such networking environments are commonplace in offices, enterprise-wide computer networks, intranets, and the Internet.

When used in a LAN networking environment, the computer 80 is often connected to the local area network 106 through a network interface or adapter 108. When used in a WAN networking environment, the computer 80 typically includes a modem 109 or other means for establishing high-speed communications over WAN 107, such as the Internet. A modem 109, which may be internal or external, is connected to system bus 83 via serial port interface 98. In a networked environment, program modules depicted relative to personal computer 80, or portions thereof, may be stored in the remote memory storage device 105. It will be appreciated that the network connections shown are exemplary and other means of establishing a communications link between the computers may be used. A number of program modules may be stored on hard disk 87, magnetic disk 89, optical disk 91, ROM 84, or RAM 85, including an operating system 95 and fragment manager 96.

The described example of a computer system does not imply architectural limitations. For example, those skilled in the art will appreciate that the present invention may be implemented in other computer system configurations, including multiprocessor systems, network personal computers, minicomputers, mainframe computers, and the like. The invention may also be practiced in distributed computing environments, where tasks are performed by remote processing devices that are linked through a communications network. In a distributed computing environment, program modules may be located in both local and remote memory storage devices.

The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer," "optionally," "may," and similar terms are used to indicate that an item, condition or step being referred to is an optional (not required) feature of the invention.

What is claimed is:

1. A method of positioning an elevator above a spider on a rig, comprising the steps of:

descending the elevator relative to the spider using a drawworks, wherein the spider comprises a sensor mounted on a timing ring coupled to a slip movable within the spider;

detecting with the sensor that the elevator has reached a predetermined proximity to the spider;

generating a signal to a controller in response to the detection by the sensor; and using the signal to at least one of activate an audible alarm to alert a driller to the proximity of the elevator to the spider, activate a visual indicator to alert a driller to the proximity of the elevator relative to the spider, activate the drawworks to slow descent of the elevator and activate the drawworks to terminate descent of the elevator.

2. The method of claim 1 further comprising the step of positioning the proximal end of a tubular string supported by the elevator above the spider to facilitate making-up or breaking-out a threaded connection between the tubular string and a tubular segment.

3. The method of claim 1, further comprising the step of detecting that the elevator has reached a second predetermined proximity to the spider.

4. The method of claim 2, further comprising the steps of:

detecting that the elevator has reached a second predetermined proximity to the spider; and actuating movement of a set of slips of the spider to engage and support the tubular string.

5. The method of claim 3, further comprising the step of generating a signal to a visible indicator and to an audible indicator to alert a driller to set the slips of the spider into engagement with the tubular string.

6. The apparatus of claim 1, wherein the sensor is selected from a group consisting of: a tilt switch, a radar sensor, an ultrasonic sensor, an ultrasonic pulse echo device, a photoelectric sensor, and a laser distance measurement device.

7. The method of claim 4, further comprising the step of:

interlocking the elevator and the spider so that one of the elevator and the spider cannot release the tubular string until the other of the elevator and spider supports the tubular string.

8. The method of claim 1, wherein the step of using the signal to at least one of activate an audible alarm to alert a driller to the proximity of the elevator to the spider, activate a visual indicator to alert a driller to the proximity of the elevator relative to the spider, activate the drawworks to slow descent of the elevator and activate the drawworks to terminate descent of the elevator comprises:

using the signal to activate the drawworks to slow descent of the elevator to a rate permitting retraction of the timing ring within an operating zone of the timing ring and from a first position, corresponding to a retracted position of the at least one slip, to a second position, corresponding to an engaged position of the at least one slip;

wherein the method further comprises the step of:

terminating descent of the elevator at a position that disposes at least a portion of the elevator within the operating zone of the timing ring.

9. The method of claim 8, wherein the second position of the timing ring is generally adjacent to a spider body relative to the first position of the timing ring.

10. A method of positioning an elevator above a spider on a rig, comprising the steps of:

descending the elevator relative to the spider;

detecting with a sensor that the elevator has reached a proximity to the spider; and alerting a driller to the proximity of the elevator relative to the spider wherein the step of detecting comprises the step of monitoring the position of a line having a first end in a fixed position and second end coupled to a component that moves with the elevator.

11. The method of claim 10, wherein the line is at least one of a Kelly hose, a hydraulic hose bundle, and a pneumatic hose bundle.

12. The method of claim 10, wherein the step of monitoring the position of a line includes the step of monitoring an angle at a selected point along the length of the line.

13. The method of claim 12, wherein the angle is monitored using a switch coupled to the line at the selected point.

14. The method of claim 13, further comprising the steps of:

empirically determining the selected point by lowering the elevator to the proximity with the spider; and coupling the switch to the line at a point where the switch will produce a signal at arrival of the elevator at the proximity during descent of the elevator.

15. An apparatus to handle a tubular string on a rig, comprising:

an elevator with a set of actuated slips to selectively support and release the tubular string;

a drawworks to controllably raise and descend the elevator;

a spider with a set of actuated slips to selectively support and release the tubular string;

an elevator sensor to detect the proximity of the elevator to the spider as the elevator descends towards the spider;

a spider engagement sensor to detect that the spider has been set to engage the tubular string; and a controller in communication with the elevator sensor and a spider slips actuator;

wherein the controller instructs the drawworks to slow descent of the elevator in response to a signal from the elevator sensor indicating the position of the elevator, and the controller actuates the spider actuator forcing the spider slips to engage the tubular string in response to a signal from the elevator sensor indicating the position of the elevator;

wherein the controller instructs the drawworks to terminate the descent of the elevator in response to a signal from the spider engagement sensor indicating that the spider has been set;

wherein the controller actuates the elevator actuator forcing the elevator slips out of engagement of the tubular string in response to detecting that the load of the tubular string has been transferred to the spider;

wherein the elevator sensor is a switch coupled to a line coupled between the rig and a component that descends vertically with the elevator, wherein movement of the elevator to a predetermined height causes a change in the angle of the line that initiates a signal from the switch.

16. An apparatus to handle a tubular string on a rig, comprising:

an elevator with slips actuated to support and release the tubular string;

a drawworks actuated to raise and descend the elevator;

a spider with slips actuated to support and release the tubular string;

an elevator sensor to detect the proximity of the elevator to the spider as the elevator descends towards the spider using the drawworks;

a spider sensor to detect spider engagement with the tubular string; and a controller to communicate with the elevator sensor, the spider sensor, the elevator slips actuator, the drawworks, and the spider slips actuator;

wherein the controller instructs the drawworks to at least one of slow and terminate descent of the elevator in response to a signal from the elevator sensor;

wherein the controller instructs the spider to engage the tubular string in response to a signal from the elevator sensor;

wherein the controller instructs the drawworks to terminate the descent of the elevator in response to a signal from the spider sensor;

wherein the controller actuates the elevator to disengage the tubular string in response to a signal indicating that the load of the tubular string is on the spider;

wherein the elevator sensor is a switch coupled to a portion of a line coupled between the rig and at least one component that moves with the elevator; and wherein movement of the elevator to a predetermined position causes a change in the angle of the portion of the line that generates a signal from the switch.

* * * * *